United States Patent [19]

Arai

[11] 4,332,504

[45] Jun. 1, 1982

[54] EXPANSION JOINTS FOR ROADS

[76] Inventor: Motonosuke Arai, 12-go, 4-ban, Iwazone-cho, Ashiya City, Hyogo Prefecture, Japan

[21] Appl. No.: 91,356

[22] Filed: Nov. 5, 1979

[51] Int. Cl.[3] ..... E01C 11/04

[52] U.S. Cl. ..... 404/68; 14/16.5; 52/396

[58] Field of Search ..... 404/68, 69, 51, 50, 404/47, 87, 74; 52/396; 14/16.5

[56] References Cited

U.S. PATENT DOCUMENTS

| | | | |
|---|---|---|---|
| 1,505,174 | 8/1924 | Triol | 404/50 X |
| 1,586,326 | 5/1926 | Older | 404/51 |
| 1,788,432 | 1/1931 | Jaspert | 404/47 |
| 1,825,021 | 9/1931 | Strand | 404/47 |
| 2,063,654 | 12/1936 | Awbrey | 404/47 |
| 2,078,693 | 4/1937 | Simrall | 404/50 |
| 2,138,817 | 12/1938 | Jacobson | 404/68 X |
| 2,278,023 | 3/1942 | Robertson | 404/51 |
| 2,311,286 | 2/1943 | Tufts | 404/50 |

FOREIGN PATENT DOCUMENTS

| | | |
|---|---|---|
| 50-91929 | 7/1975 | Japan . |
| 50-117224 | 9/1975 | Japan . |
| 53-141052 | 11/1978 | Japan . |
| 54-13627 | 2/1979 | Japan . |
| 54-144734 | 11/1979 | Japan . |

*Primary Examiner*—Nile C. Byers, Jr.
*Attorney, Agent, or Firm*—Auslander, Thomas & Morrison

[57] ABSTRACT

An expansion joint of the construction that opposing upper wavy end face plates with a regular gap therebetween and lower wavy end face plates with the upper end thereof bonded to the lower end of the upper wavy end face plates are provided oppositely, an elastic means is interposed between said both upper wavy end face plates, upper edge of said upper wavy end face plates are provided in flush with or close to the road surface, anchor materials are provided protrudingly at the back of said both upper wavy end face plates and are connected to reinforcing material, concrete or synthetic resin is placed at the back of each of said wavy end face plates and a small gap is provided between the lower end of said lower wavy end face plate and the bottom surface of a joint fitting portion to prevent the both from touching with each other.

11 Claims, 22 Drawing Figures

EXPANSION JOINTS FOR ROADS

BACKGROUND OF THE INVENTION

This invention relates to expansion joints for bridging joints between pavement slabs in road bridges and elevated roads.

In order to compensate for expansion and contraction of concrete floor slabs, prestressed concrete girders, concrete girders, steel floor slabs, etc. in roads caused by changes in ambient temperature, it has been general practice to provide expansion members at the joints. For example, opposing end faces of adjacent concrete floor slabs at the joint are of such a type that as shown in FIG. 22, wavily bent vertical end face plates a, a are placed oppositely with a regular space b therebetween and thereafter concrete is deposited at the back thereof. This vertical end face plate a can be formed into an assembled joint member suitable for use at the installing site by carrying out welding of reinforcing material and preliminary assembling work at a factory or in the vicinity of the joint of a road. However, for the reasons of execution of works, transportation and standardization of size, height c of the vertical end face plate is limited to only several kinds within the range of 100–220 mm. Therefore, the thickness of a protrusion e of after-concreting enclosed with the vertical end face plate is inevitably smaller than the thickness of the floor slab and is not durable enough to stand the high load. In addition, depending upon the structure of a road, configuration of the neighbouring ground and executing conditions, the depths of opposing floor slabs at cutout portion are made larger than originally planned or are made different from each other. In these cases, the above-mentioned disadvantages become more conspicuous, involving such a defect as lack of unbalance of durability to load given by passing vehicles.

Whenever a vehicle passes over an elastic seal means of groove shape, air is sucked or sent into the groove, which generates noises. In order to prevent such noises, elastic seal or the like is usually filled in such sealing rubber. Moreover, such sealing rubber is expensive and tends to age. Also, one of the features of the above-mentioned vertical type expansion joint for roads using wavily bent end face plates is that its wavy expansion spacing at the level of the road surface involves less shock caused by slipping of vehicle tyres into the groove, as compared to the case of linear expansion spacing. It is only natural that the larger the angle of bend, the less the shock is given to a vehicle passing over it but, on the other hand, in the case of a skew bridge, such problems as limitation on the angle of bend, increased steps in the process, higher cost, etc. are raised and it is therefore required to set the angle of bend properly.

SUMMARY OF THE INVENTION

The present invention has been made to eliminate the above-mentioned defects, more particularly, the present invention provides expansion joints for roads of such type that a vertical end face plate comprises an upper wavy end face plate and a lower wavy end face plate and by connecting both end face plates together and installing them at the joint member securing portion, installation work of the upper wavy end face plate is made easier; thickness of the protrusion of after-concreting is made larger; and durability to load is increased; and also the wavy end face plate is made flat at both edges of the road, the joint clearance between wavy end face plates is provided either the inside or the outside of both end faces of the expansion spacing of the joint, the wavy configuration of the wavy end face plate is adapted to different construction conditions according to the amount of expansion and contraction at the joint portion and the direction of bridging, and improvement has been made in the efficiency of installing end face plates at both edges of a road, wavy end face plates and elastic seal means.

The present invention provides expansion joints for a road of such construction that in the joint member securing portions which oppose each other through the medium of an expansion spacing, adjacent upper wavy end face plates each of which is connected with respective lower wavy end face plate are opposed with a regular gap therebetween and the upper edge of said upper wavy end face plate is provided exactly or nearly flush with the road surface, an expansion member made of elastic material such as rubber is interposed between opposing upper wavy end face plates, anchor material and reinforcing material are provided at the back of the both upper way end face plates, concrete or the like is deposited at the back of each wavy end face plate and a small gap is made between the lower edge of the lower wavy end face plate and the bottom surface of the joint member securing portion.

Preferred embodiments of the present invention will now be more particularly described with reference to the accompanying drawings in which.

DETAILED DESCRIPTION OF PREFERRED EMBODIMENTS

Embodiment No. 1

Figure 3:
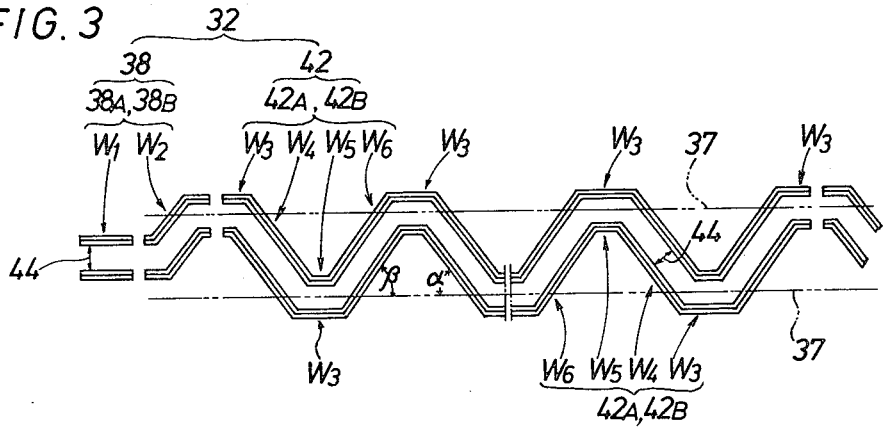
FIG. 3 is a sketch showing the plan view of an end face plate of embodiment No. 1, as it is sectioned.

This embodiment is characterized in that the angle $\alpha$ and the angle $\beta$, each of which is formed by a wall in a wavy end face plate and the end face of an expansion spacing at the joint portion, are equal to each other as is best shown in FIG. 3 where an end face plate 32 is shown in plan view as it is sectioned into an end face plate 38 at a lateral edge portion and an wavy end face plate 42.

Figure 1:
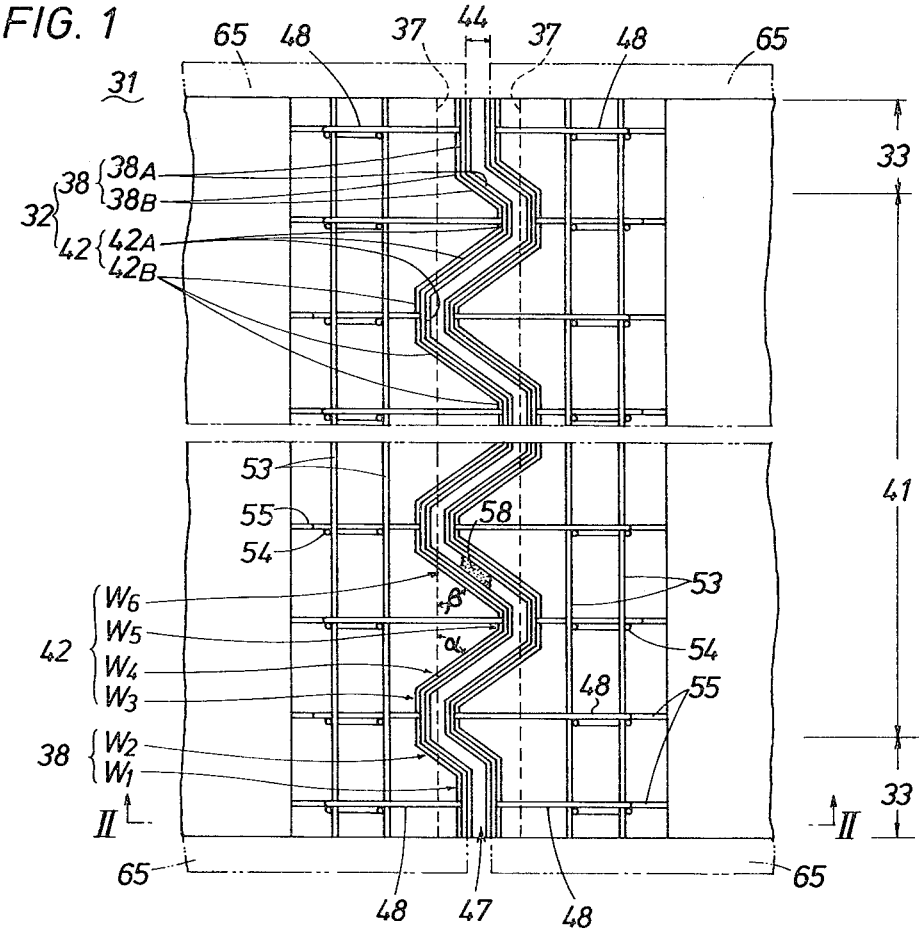
FIG. 1 is a plan view of the expansion joint in embodiment No. 1, with no after-concreting.
Figure 2:
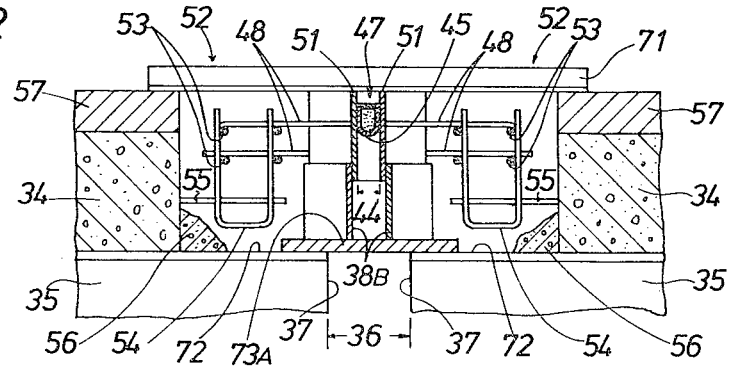
FIG. 2 is a cross section of the expansion joint taken on the line II—II of FIG. 1.
Figure 4:
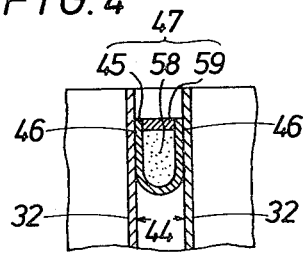
FIG. 4 is an enlarged view of an elastic seal means of embodiment No. 1.
Figure 9:
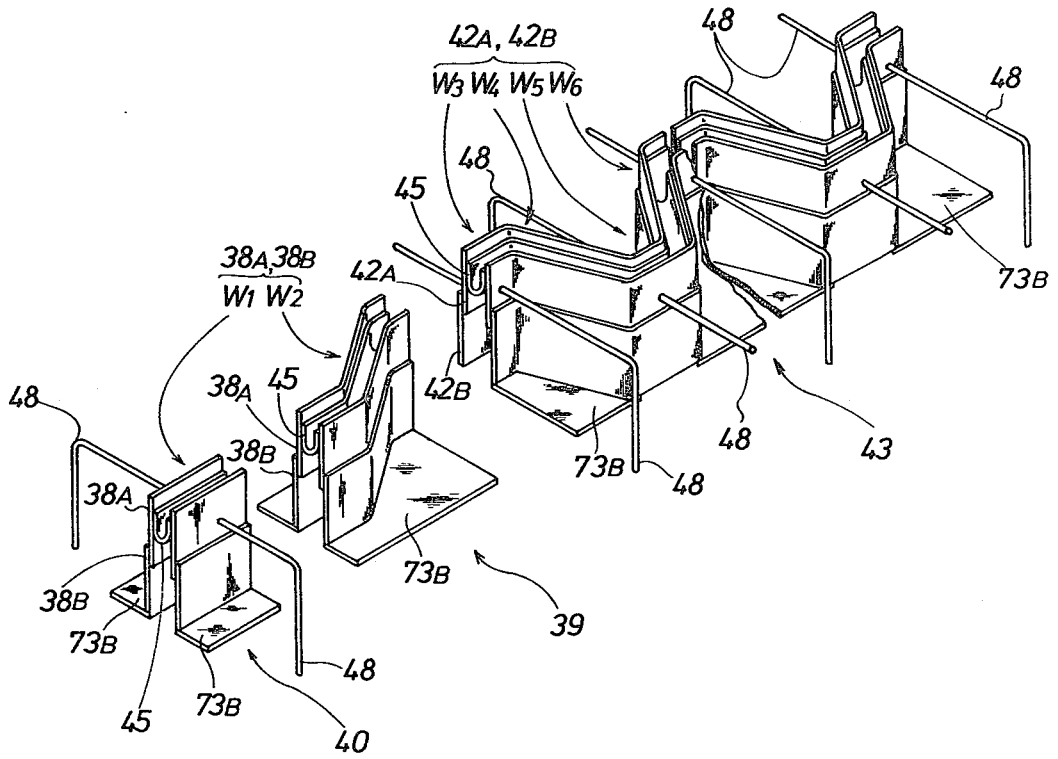
FIG. 9 is a perspective view of each joint member of embodiment No. 1.
Figure 10:
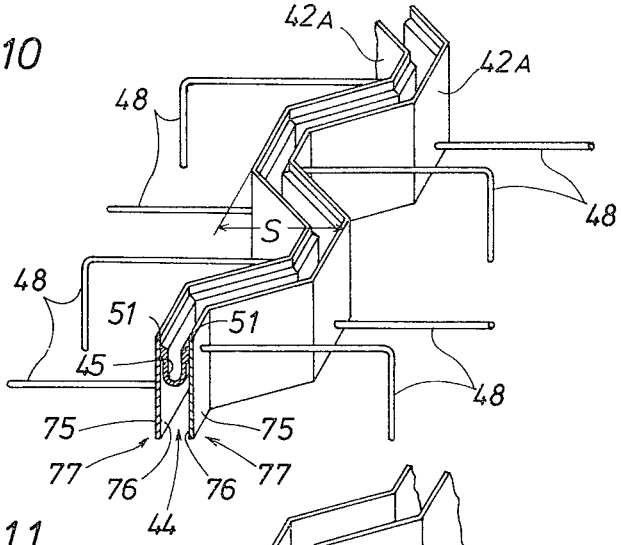
FIG. 10 is a perspective view of a part of an upper wavy end face plate of the intermediate joint member of embodiment No. 1 cut in lengthwise direction of a bridge.
Figure 11:
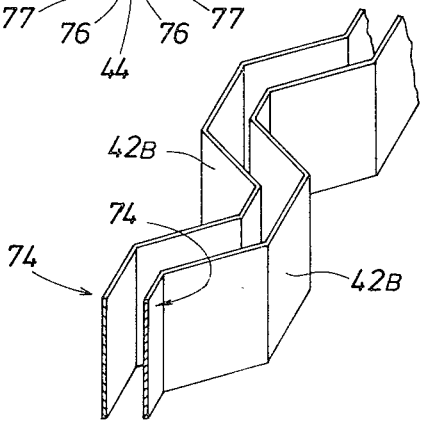
FIG. 11 is a perspective view of a part of a lower wavy end face plate of embodiment No. 1 cut in lengthwise direction of a bridge.
Figure 12:
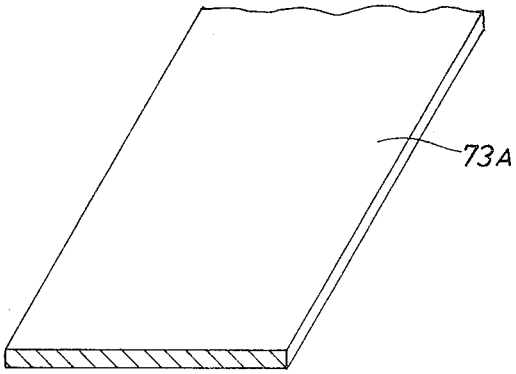
FIG. 12 is a perspective view of a part of a bottom member of embodiment No. 1 cut in lengthwise direction of a bridge.

Numeral 31 is an expansion joint for a road according to the present invention. Numeral 32 is an end face plate of steel comprising an end face plate 38 at a lateral edge portion, including an upper end face plate at a lateral edge portion 38A and a lower end face plate at a lateral edge portion 38B of a lateral edge portion 33 of road, and a wavy end face plate 42, including an upper wavy end face plate 42A and a lower wavy end face plate 42B of a road intermediate portion. In a road joint portion, the afore-mentioned upper wavy end face plates 42A, 42A are opposed to each other with a regular wavy gap 44 therebetween; reinforcing materials 48, 48 are provided protrudingly, in lengthwise direction of a bridge, at the back of said upper wavy end face plates; an intermediate joint member 43 (FIG. 9) is formed by heat-bonding an expansion member 45, such as an expansion plate of groove shape made of rubber or other soft and elastic material, between said both upper wavy end face plates; upper edges 51, 51 of said upper wavy end face plates are made to be exactly or nearly flush with the surface of pavement 57 by using a lateral rod 71 (FIG. 2); the center of the opposing width S (FIG. 10) between said upper wavy end face plates 42A, 42A is made to conform to the center of the expansion spacing 36 of floor slabs 34, 34 (the fixed position of cutout portion 52, 52); a bottom member 73A made of styrene foam plate, rubber plate or the like which is softer than steel or concrete and has a sufficient thickness (10 m.m., for example) to prevent the lower end of a lower wavy end face plate 42B (to be mentioned later) from touching a bottom 72 of the cutout portion 52 is laid in bridging state; lower wavy end face plates 42B, 42B are mounted on said bottom member 73A in opposing state; upper edge portions 74, 74 of said lower wavy end face plates 42B, 42B are butted to lower edge portions 77, 77 of the backs 75, 75 (or opposing inner faces 76, 76 in some cases) of said upper wavy end face plates 42A, 42A and the both wavy end face plates 42A, 42A and 42B, 42B are fixed together by means of spot welding, intermittent welding, etc. to be formed into wavy end face plates 42, 42; the aforementioned reinforcing members 48, 48 are welded to a main reinforcement 53, a bearing reinforcing bar 54 and a distribution bar 55 at intersections; and cement or resin concrete 56 is placed at the back of end face plates 32, 32 (FIG. 4).

Figure 13:
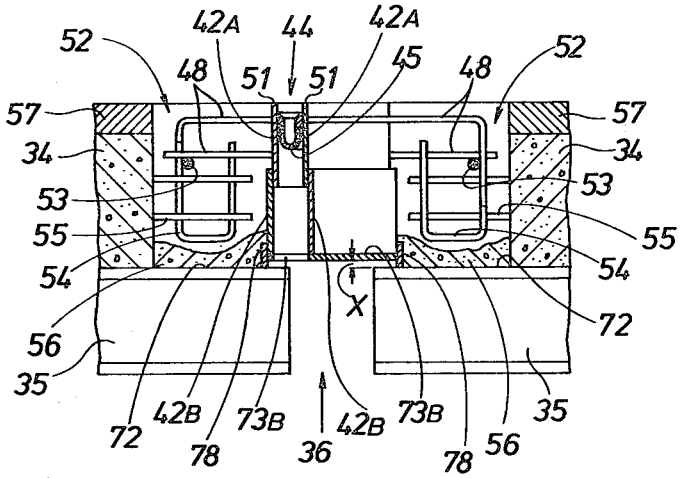
FIG. 13 is a cross section of a part of the expansion joint, showing another embodiment of a bottom member in embodiment No. 1.

The bottom member 73A made of styrene foam plate may be replaced by a bottom plate 73B (FIG. 13) which is kept from touching the bottom 72 of the cutout portion 52 by sheathing boards 78, 78 which are fixed at the back of the lower wavy end face plate 42B and at the side of the bottom plate 73B, whereby an interval X is made between the bottom plate 73B and the bottom 72 of the cutout portion 52.

The above-mentioned wavy end face plates 42A, 42B can be thin wavy plates (deck plates, corrugated plates, etc.) available on the market.

In the above embodiment, the cutout portion 52 is provided on a main girder 35 but a prestressed concrete girder (PC girder) or a concrete girder can be used instead of a main girder.

The afore-mentioned end face plates 32, 32 are in parallel with expansion spacing end faces 37, 37 of concrete floor slabs 34, 34 or main girders 35, 35 at the lateral edge portions 33, 33 of the road and an end face plate 38 at the lateral edge portion is composed inside both end faces 37, 37 of expansion spacing (or outside of or at the position in conformity to both end faces 37, 37) of an opposing first wall $W_1$ and a second wall $W_2$ which is opposed to the first wall in oblique direction. In the case where expansion spacing of adjacent floor slabs is made small due to shortness and small expansion of bridge girders, the first walls $W_1$, $W_1$ can be provided at the outside of the expansion spacing end faces 37, 37 or with the first wall $W_1$ conformed to the expansion spacing end faces 37, 37. Where necessary, the second wall $W_2$ can be provided at a right angle to the first wall $W_1$.

In the road intermediate portion 41 between the lateral edge portions 33, 33, wavy end face plates 42, 42 are formed by a third wall $W_3$ in parallel with said expansion spacing end faces 37, 37, a fourth wall $W_4$ forming the angle $\alpha$ in relation to said expansion spacing end face, a fifth wall $W_5$ in parallel with said expansion spacing end face and a sixth wall $W_6$ forming the angle $\beta$, which is equal to the angle $\alpha$, in relation to said expansion spacing end face. Said wavy end face plates 42, 42 and the aforementioned end face plates 38, 38 at the lateral edge portion are opposed to each other, with a regular gap 44 therebetween, and are connected to conform to the road width or a widthwise length of the road. The aforementioned angles $\alpha$ and $\beta$ are so set that they are within the range of 25°–60°.

Upper end portions 46, 46 of an expansion member 45 made of soft material such as rubber, synthetic resin or the like are heat-bonded to upper end portions of the afore-mentioned upper end face plates 38A, 38A at the lateral edge portions and the upper wavy end face plates 42A, 42A. Thus, the expansion member 45 of U shape in section is held deformably and a watertight elastic seal means 47 is composed of the expansion member 45, a particle layer 58 and a soft covering layer 59 (to be mentioned later).

The expansion joint according to this embodiment is a universal type and can be applied to a wide range including a long bridge with large expansion spacing, a short bridge with small expansion spacing and even a skew bridge.

Embodiment No. 2

Figure 7:
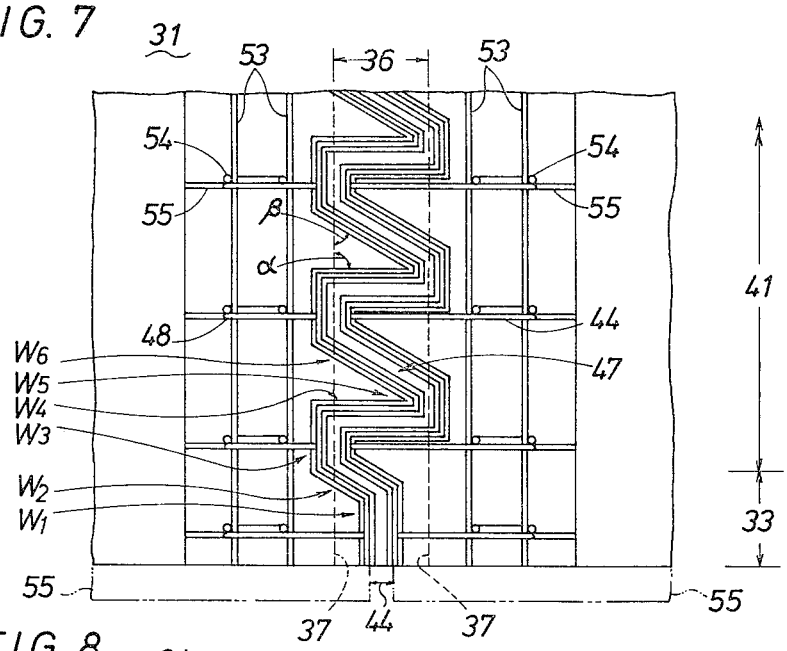
FIG. 7 is a plan view of the expansion joint in Embodiment No. 2, with no after-concreting.

This embodiment is the case where the angle $\alpha$ and the angle $\beta$ formed between two wavy walls and expansion spacing end faces are unequal to each other. This embodiment is shown only in FIG. 7 in plan view.

This embodiment is the same as Embodiment No. 1, with the exception that the angle $\alpha$ formed between the expansion spacing end face 37 and the fourth wall $W_4$ of the wavy end face plate 42 is made larger than the angle $\beta$ formed between said expansion spacing end face 37 and the sixth wall $W_6$ of said wavy end face plate 42, or the angle $\alpha$ is made almost equal to the right angle, or the angular ratio of the angle $\alpha$ and the angle $\beta$ is in an inverse relationship.

The expansion joint of this embodiment is especially suited for a long bridge with big expansion spacings and can lessen shocks generated when a vehicle passes over it.

Embodiment No. 3

Figure 8:
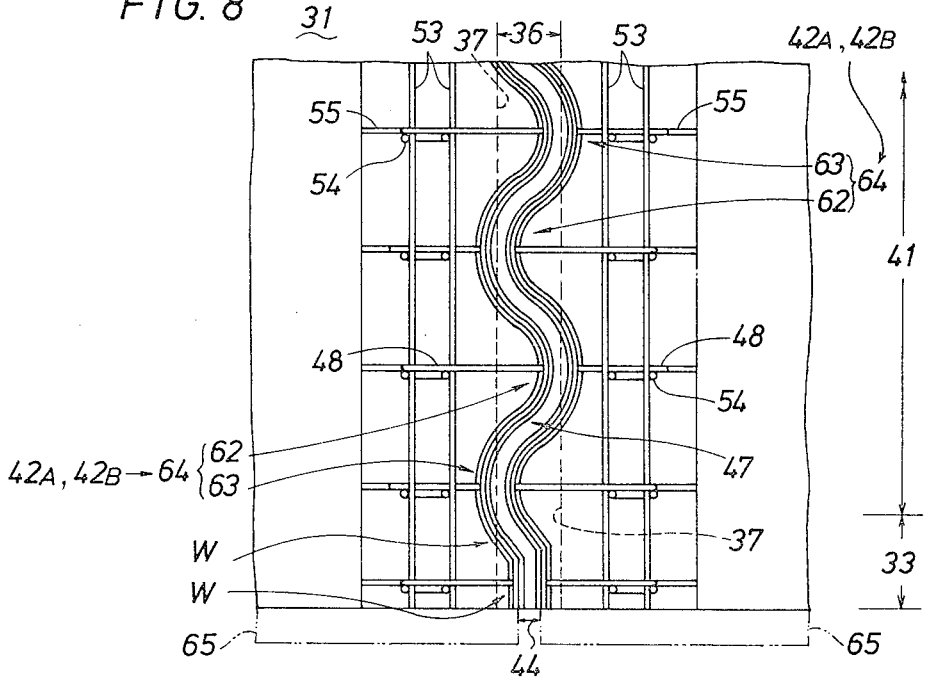
FIG. 8 is a plan view of the expansion joint in Embodiment No. 3, with no after-concreting.

This embodiment is shown only in FIG. 8 in plan view and is the case where configuration of wave shapes in the wavy end face plate is arcuate. This embodiment is the same as Embodiment No. 1, excepting that wavy end face plates 42, 42 are bent in such a fashion that they have convex arcuate walls 62 and concave arcuate walls 63 alternately alongside the end face of expansion spacing end face 37 and thus made into opposing arcuate walls 64, 64 with a regular gap 44 therebetween. The expansion joint of this embodiment is especially suited for a short bridge with small expansion spacing. It is simple in construction and easy to install.

At a factory or in the vicinity of an installing site, firstly an intermediate joint member 43 of 1–2 meters in length is formed by setting up upper wavy end face plates 42A, 42A in opposition, using a proper framework, by heat-bonding an expansion member 45 to the end face plates, and by fixing reinforcing materials at the back of said upper wavy end face plates 42A, 42A. At the same time, an offset joint member 39 and an extreme lateral edge joint member 40 which constitute upper lateral edge end face plates 38A, 38A are formed in the desired length and in the construction similar to the intermediate joint member 43. After the preparatory processing of the joint members 39, 40, 43 is completed, they are delivered to the actual spot for installation.

At an intermediate portion 41 of a road, bottom members 73A (73B) are mounted over main girders 35, 35 with an expansion spacing 36 between concrete floor slabs 34, 34 therebetween; lower end face plates 42B, 42B are set on said bottom members to fit the back surface of the upper end face plate 42A to the opposing inner surfaces of said lower end face plates; upper edges 51, 51 of said upper end face plate 42A are welded to the substantially same level as the surface of a pavement 57; several intermediate joint members 43, each 1–2 meters in length, are arranged as they are combined and are connected together into an integral member; reinforcing materials 48 for said intermediate joint member 43 are connected by welding to steel bars 53, 54, 55 at intersections.

Then, at the lateral edge portion 33, 33 of roads, an offset joint member 39 and the extreme lateral edge joint member 40 are arranged connectively to the intermediate joint member 43. In the same way as in the case of the intermediate joint member 43, the back of the upper lateral edge end face plate 38A is welded to the inner surfaces of opposing lower lateral edge end face plates 38B, 38B and reinforcing materials 48 are welded and fixed to steel bars 53, 54, 55. Thus, joint members 39, 40, 43 are connected to each other and expansion members 45, 45 are also connected to each other and lastly concrete 56 is placed at the back of joint members 39, 40, 43 and the cutout portion 52.

The elastic seal means 47 comprises the expansion member 45 in which mineral particles which are non-water absorptive and weathering-resistant are filled to form a particle layer 58 and a soft covering layer 59 of rubber or the like. Thus, the expansion joint 31 is completed.

The installation of the expansion joint can also be carried out in the following way.

Instead of a construction in which the cutout portion 52, 52 are formed by chipping the opposing ends of floor slabs 34 and joint members 39, 40, 43 are connected to said cutout portions, an unconcreted portion (not shown in the drawing) is made at opposing ends of floor slabs when making floor slabs 34, 34 by concreting, and supporting bars 54, 54 at the bottom of the unconcreted portions are connected to both reinforcing materials 48, 48 and main reinforcement 53, 53 and the bottom member 73A (73B) is mounted between lower edges of lower end face plates 38B, 42B of joint members 39, 40, 43 and the bottom of the unconcreted portion. Then, concrete 56 is placed in the unconcreted portion. In areas of snowfall, in preparation for wear and tear of the surface of pavement 57 by repeated snow-removing work, it is possible that the upper edges 51, 51 of the end face plates 32, 32 are made lower than the level of the pavement 57 so as to prolong the cycle of repairing expansion joint due to exposure of the upper edge 51.

Figure 5:
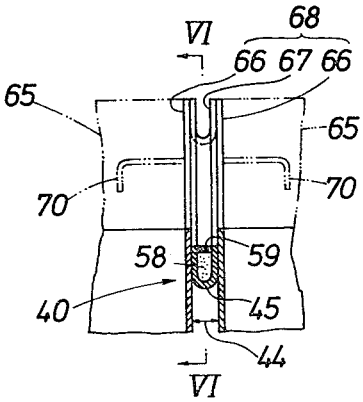
FIG. 5 is a front view of an elastic seal means at the curb portion of embodiment No. 1, 2 and 3.
Figure 6:
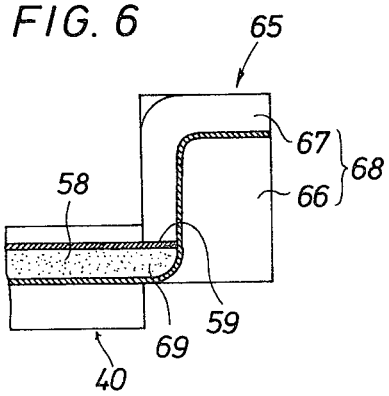
FIG. 6 is a cross section of the elastic seal means taken on the line VI—VI of FIG. 5.

Now, referring to the watertight construction at a curb portion, as shown in FIG. 5 and FIG. 6, numeral 65 denotes curb portions at both ends of the road width. Flat end face plates 66, 66 at the curb portions are opposed to each other with a gap 44 (the same gap as in the case of end face plates 38A and 42A) therebetween. An inverted-L shaped expansion member 67 is connected at its upper end to the end face plate 66 which is nearer the edge of road and thus a joint member 68 at the curb portion is formed. The expansion member 67 is connected to the expansion member 45 of the extreme lateral edge joint member 40 and the lower edge (at the road side) of the curb joint member 68 is connected to the upper edge of the extreme lateral edge joint member 40. The particle layer 58 and the soft covering layer 59 of the elastic seal means 47 are extended to a part 69 of the curb portion 65 and the back of the curb joint member 68 is fixed to concrete of the curb portion 65 by the reinforcing material 70.

Embodiment No. 4

This embodiment differs from Embodiment No. 1 in respect of the elastic seal means.

Figure 14:
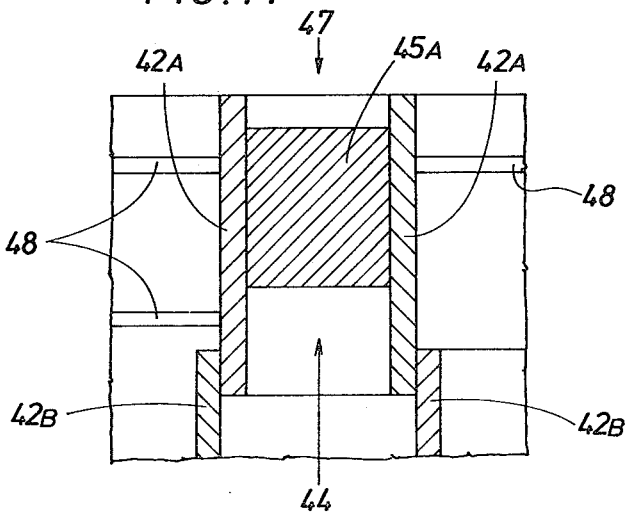
FIG. 14 is a cross section of a part of the expansion joint, showing the elastic seal means of Embodiment No. 4.

As shown in FIG. 14, the elastic seal means 47 has an expansion member 45A which is made by providing a proper bottom member (for example, styrene foam plate) between upper wavy end face plates 42A, 42A and liquefied rubber or other soft, flexible material is poured into gap 44 where it sets. This means is employed widely.

Embodiment No. 5

This embodiment also differs from Embodiment No. 1 in respect of the elastic seal means.

Figure 15:
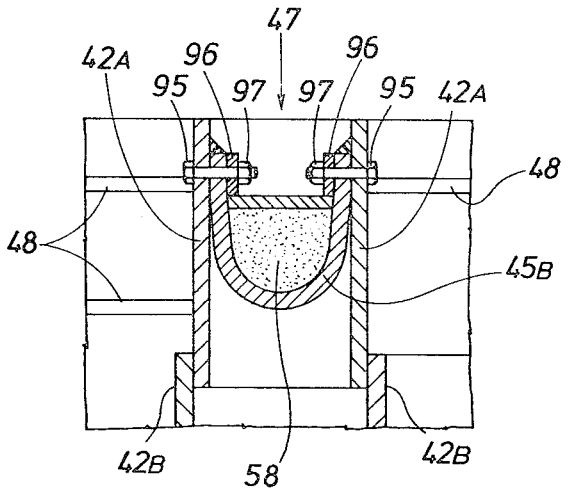
FIG. 15 is a cross section of a part of the expansion joint, showing the elastic seal means of Embodiment No. 5.

As shown in FIG. 15, the elastic seal means 47 is secured by bolts 95 passing through bolt holes in both ends of the elastic member 45B (similar to the elastic member 45 in Embodiment No. 1) at regular intervals in road width direction and through the upper wavy end face plates 42A, 42A and then tightening the bolts by nuts 97, using washers 96. This embodiment is similar to Embodiment No. 1 in other respects.

Embodiment No. 6

This embodiment also differs from Embodiment No. 1 in respect of the elastic seal means.

Figure 16:
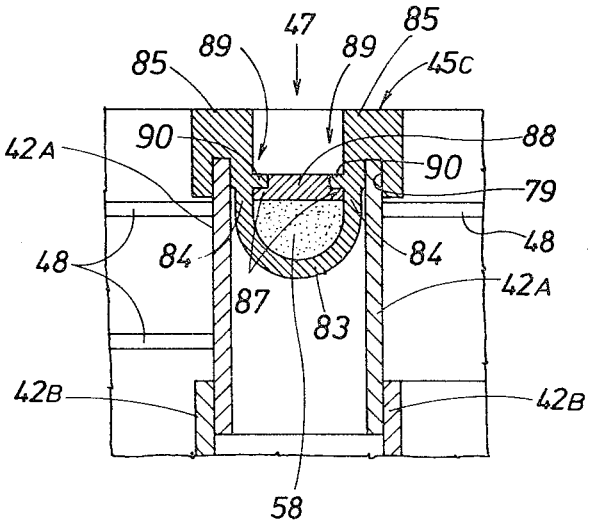
FIG. 16 is a cross section of a part of the expansion joint, showing the elastic seal means of Embodiment No. 6.

As shown in FIG. 16, the elastic seal means 47 is composed of an expansion member 45C, a particle layer 58 and a sealing member 88. The expansion member 45C is made of rubber or other soft, elastic material and has an expansion portion 83 at the middle part thereof. Cushion portions 85, 85 are made integrally with both end portions 84, 84. Fitting grooves 79 are made in the both cushion portions and are fitted in the upper edges of the upper wavy end face plates 42A, 42A and are fixed. The particle layer 58 is provided in the groove of said expansion portion 83. A sealing member (sealing lid) 88 having a T-shaped cross section and having at both ends thereof fitting portions 87, 87 is pressed upon the surface of the particle layer 58. Thus, fitting portions 90, 90 of the t shape provided at the upper portion 89 of the expansion member 83 lock the fitting portions 87, 87.

Embodiment No. 7

This embodiment is similar to Embodiment No. 6 in the shape of the elastic seal means.

Figure 17:
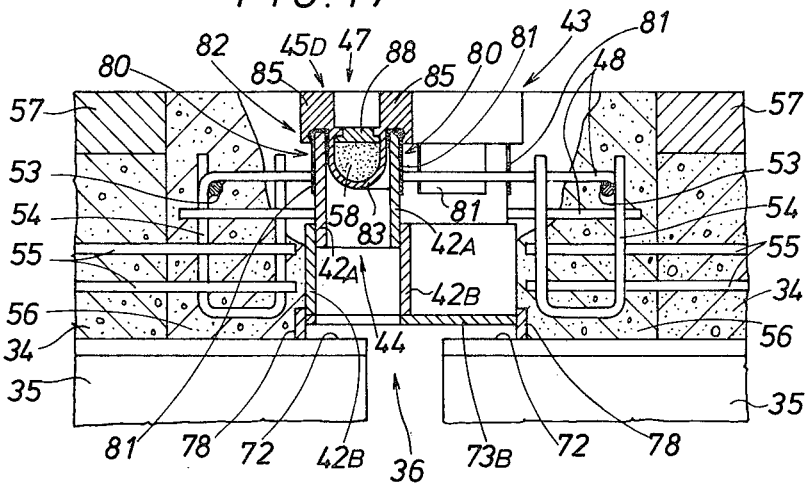
FIG. 17 is a vertical cross section, in lengthwise direction of a bridge, of the expansion joint shown in FIG. 7.
Figure 18:
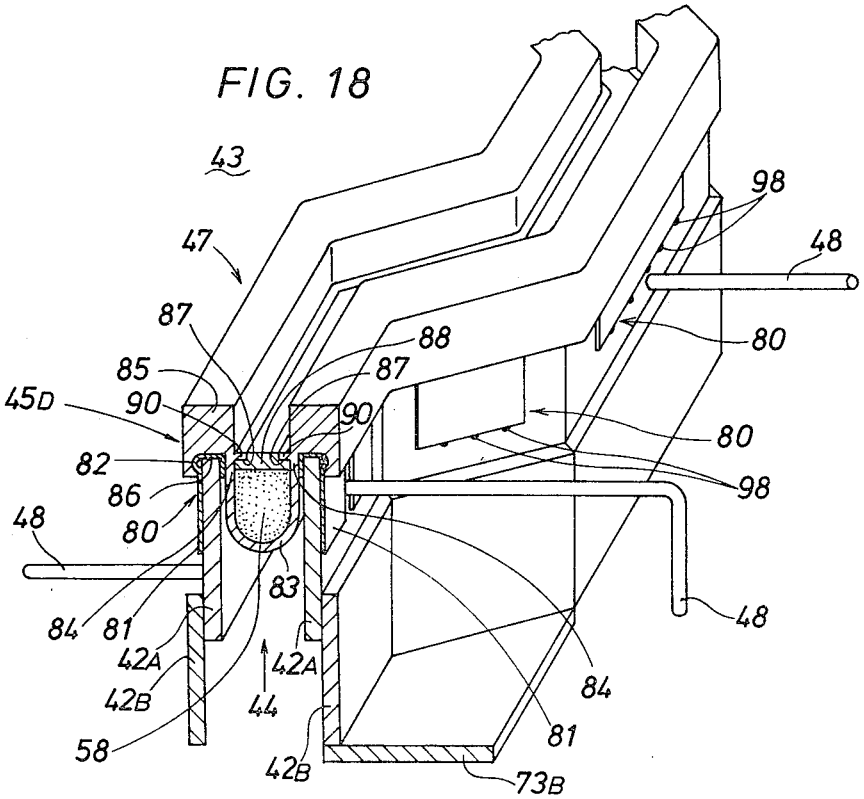
FIG. 18 is a perspective view of the expansion joint of FIG. 17.

As shown in FIG. 17 and FIG. 18, the elastic seal means 47 is composed of an expansion member 45D, a connecting metal fitting 80, a particle layer 58 and a sealing material 88. The connecting metal fitting 80 comprises a connecting part 81, a bonding part 82 and a groove part 86 which is made by bending a steel sheet in 7-shape in cross section. The expansion member 45D is made of rubber or other soft, elastic material and has an expansion part 83 at the middle thereof. Cushion portions 85, 85 are made integrally with both ends 84, 84 of the expansion part 83. These cushion portions 85, 85 are bonded to the surfaces of the outer side, upper side and inner side of the groove portion 86, which are fitted to the upper end of the end face plate 32, whereby the connecting metal fitting 80 is fixed.

The composition of the particle layer 58 and the sealing material 88 is the same as in the case of Embodiment No. 6 and therefore no explanation is made of it. In the elastic seal means of this embodiment, the groove 86 of the connecting metal fitting 80 is fitted to the upper ends of the end face plates 32, 32 and the connecting portions 81, 81 of said connecting metal fitting 80 are welded and fixed to the back of the end face plates 32, 32 by spot-welding.

The above-mentioned connecting metal fitting 80 may be formed with the connecting part 82 extending downwardly to form a u-shaped cross section and the part which extends down the inner opposing surfaces of the end face plates 32, 32 is deposited.

Embodiment No. 8

This embodiment differs from any of the foregoing embodiments in respect of the elastic seal means.

Figure 19:
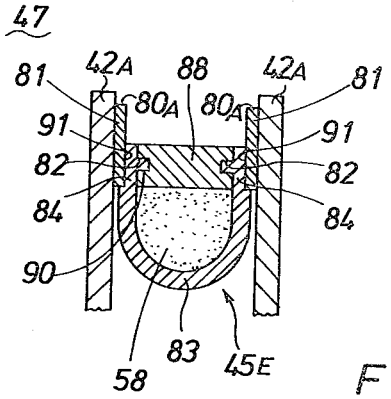
FIG. 19 is a cross section of a part of the joint member showing the elastic seal means of Embodiment No. 8.

As shown in FIG. 19, the elastic seal means 47 is composed of an expansion member 45E, a connecting metal fitting 80A, a particle layer 58 and a sealing material 88. Opposing connecting metal fittings 80A are made of steel sheet which is flat in cross section. The half of the connecting metal fitting 80A forms a contact surface 91, 91 with the expansion member 45E and the remaining half forms a connecting part 81, 81 with the end face plates 32, 32. The end portions 84, 84 of the expansion member 45E are bonded to said contact surface 91, 91 and the connecting part 81, 81 is fixed to the inner side of the end face plates 32, 32 by spot-welding. The particle layer 58 is provided in the groove of the expansion member 45E and the seal material 88 is mounted on said particle layer. This embodiment is similar to Embodiment No. 1 in the other parts.

Embodiment No. 9

This embodiment also differs from any of the foregoing embodiments in respect of the elastic seal means.

Figure 20:
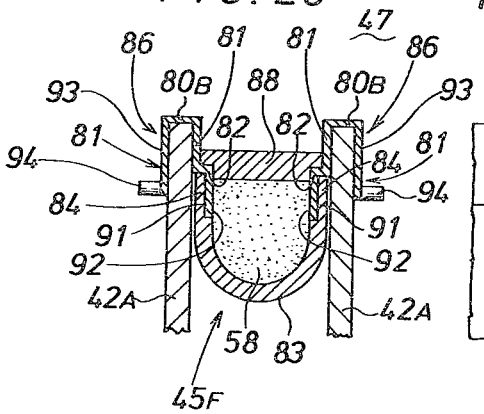
FIG. 20 is a cross section of the elastic seal means of Embodiment No. 9.
Figure 21:
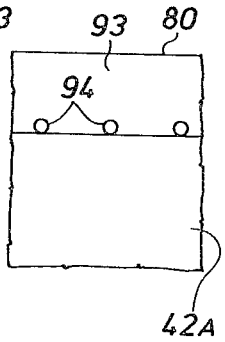
FIG. 21 is a side view of the elastic seal means of Embodiment No. 9.
Figure 22:
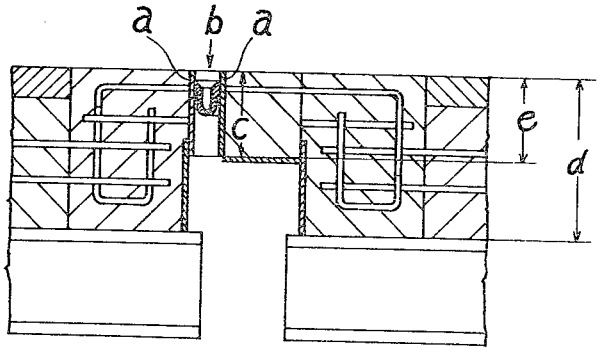
FIG. 22 is a cross section of a conventional expansion joint.

As shown in FIG. 20 and FIG. 21, the elastic seal means 47 is composed of an expansion member 45F, a connecting metal fitting 80B, a particle layer 58 and a sealing material 88. Opposing connecting metal fittings 80B are formed by bending a steel sheet in square trough in cross section. At the inner side pieces 92, 92 of said connecting metal fitting 80B are provided connecting parts 81, 81 and bonding parts 82, 82. Both ends 84, 84 of the expansion member 45F are bonded to said bonding parts 82, 82 and the remaining part is the connecting parts 81, 81. Groove parts 86, 86 of the connecting parts 81, 81 are fitted to the upper ends of the end face plates 32, 32 and the connecting parts 81, 81 are fixed to the end face plates 32, 32 by means of spot-welding or by other method. Anchor materials 94, 94 are arranged, at equal intervals, at the back of the lower end portion of outer side pieces 93, 93 of the connecting part in road width direction. This embodiment is similar to Embodiment No. 1 in all the other parts.

The following advantages are claimed for the expansion joint according to the present invention.

The expansion joint according to the present invention is constructed as mentioned above and concrete portions at the back of end face plates are formed in the thickness corresponding to the thickness of floor slab and pavement, namely, the total height of the end face plates, or 5–10 mm more than that. Therefore, even if opposing cutout portions are not uniform or are made deeper than planned, the depth of cutout portion can be utilized effectively for increasing the strength of the cutout portion. Waviness of the gap at the joint is effective for decreasing shocks given to vehicles passing over the expansion joint and for preventing water leakage at the gap between end face plates. Moreover, as the gap at the lateral edge portion of a road is made almost equal to the expansion spacing, connecting structure of the lateral end portion and a curb portion of a road can be made simple.

Such an expansion means as mentioned in the embodiments make it possible to form joint members, either linear or wavy, not only at a factory but also in the vicinity of the joints of a road. Therefore, adaptability of work to the changes of design and executing conditions is very high and the process control is easy. As the joint member can be made into divided unit parts, stock control and transportation control can be simplified to a large extent. Since fillers in the groove of the expansion member are easy to handle and are particles, such as silica, of uniform diameter, they are free from congealing. Moreover, as the particle layer is covered with a soft covering layer or sealing material, they are kept from scattering. As the upper side of the soft covering layer of the sealing material is formed in shallow groove-shape, earth and sand deposited in this groove are carried away by the natural wind or the wind generated by passing vehicles. Thus, depositing of earth and sand in the groove can be prevented. Particles to be filled are very low in cost and, coupled with the installation structure of end face plates at the lateral end portion of a road, produces sound-arresting effect. The expansion joint according to the present invention also has such advantage that it requires less work for execution and maintenance than the conventional expansion joint.

What is claimed is:

1. An expansion joint for a roadway comprising:

first and second opposed upper wavy face plates forming a substantially regular wavy gap therebetween;

an elastic seal bonded between said first and second opposed upper wavy face plates;

a first lower wavy face plate partly overlapping and extending a substantial distance below a bottom portion of said first upper wavy face plate;

a second lower wavy face plate partly overlapping and extending substantially below a bottom portion of said second upper wavy face plate;

said first and second lower wavy face plates forming a substantially regular gap therebetween;

means for supporting said first and second lower wavy face plates an interval above a horizontal support surface;

said first and second upper wavy face plates being displaceable up and down with respect to said first and second lower wavy face plates whereby different thicknesses of roadway can be accommodated;

means for joining said first upper and first lower wavy face plates and for joining said second upper and said second lower wavy face plate; and reinforcing materials affixed to said first and second upper wavy face plates and effective to maintain said expansion joint in position in said roadway in preparation for placing concrete behind first and second upper and first and second lower wavy face plates.

2. An expansion joint according to claim 1, wherein said first and second upper wavy face plates are respectively in contact with opposing inner surfaces of said first and second lower wavy face plates.

3. An expansion joint according to claim 1, wherein said first and second upper wavy end plates are respectively in contact with outside surfaces of said lower wavy face plates.

4. An expansion joint according to claim 1, wherein at least one of said first and second lower wavy face plates includes a bottom member protruding from a lower portion thereof.

5. An expansion joint according to any one of claims 1–4, wherein the wavy shapes of said upper and lower wavy face plates are a series of arcs.

6. An expansion joint according to any one of claims 1–4, wherein said elastic seal includes a grooves expansion plate of rubber-like material having first and second sides, said first side being fixed to said first upper wavy face plate and said second side being fixed to said second upper wavy face plate.

7. An expansion joint according to claim 6, wherein said elastic seal includes a groove therein, a layer of particles in said groove and a soft sealing layer covering said particles in said groove.

8. An expansion joint according to claim 7, wherein said particles are non-water absorptive, weather resistant and chemically stable.

9. An expansion joint according to any one of claims 1–4, wherein said elastic seal includes:

a sheet-metal fitting having an expansion plate and first and second bent portions along the edges thereof and an expansion plate between said bent portions; and said first and second bent portions being fittable over top edges of said first and second upper wavy face plates and fixed to inner and outer surfaces thereof.

10. An expansion joint according to any one of claims 1–4, wherein said elastic seal includes:

a sheet-metal fitting including opposing connecting metal fitting having a flat cross section and an expansion plate;

a contact surface on each of said connecting metal fittings;

end portions of said expansion plate being bonded to said contact surfaces;

a connecting portion on each of said connecting metal fittings; and each of said connecting portions being fixed to an inner surface of an upper wavy face plate.

11. An expansion joint according to any one of claims 1–4, wherein said elastic seal includes:

first and second opposed square trough-shaped sheet metal connecting fittings;

an expansion plate;

ends of said expansion plate being bonded to inner surfaces of said connecting fittings;

said first and second connecting fittings being fitted over and fixed to top edges of said first and second upper wavy face plates, respectively.

* * * * *